US011387603B2

(12) United States Patent
Lawrence et al.

(10) Patent No.: US 11,387,603 B2
(45) Date of Patent: Jul. 12, 2022

(54) PANEL MOUNT CONNECTOR WITH TERMINAL MODULE SECURED TO CONNECTOR HOUSING

(71) Applicant: Molex, LLC, Lisle, IL (US)

(72) Inventors: Tommy Lawrence, Little Rock, AR (US); Javier Resendez, Streamwood, IL (US); Takayuki Arai, Tokyo (JP)

(73) Assignee: Molex, LLC, Lisle, IL (US)

( * ) Notice: Subject to any disclaimer, the term of this patent is extended or adjusted under 35 U.S.C. 154(b) by 259 days.

(21) Appl. No.: 16/089,963

(22) PCT Filed: Mar. 31, 2017

(86) PCT No.: PCT/US2017/025441
§ 371 (c)(1),
(2) Date: Sep. 28, 2018

(87) PCT Pub. No.: WO2017/173309
PCT Pub. Date: Oct. 5, 2017

(65) Prior Publication Data

US 2020/0313356 A1 Oct. 1, 2020

Related U.S. Application Data

(60) Provisional application No. 62/316,220, filed on Mar. 31, 2016.

(51) Int. Cl.
*H01R 13/74* (2006.01)
*H01R 13/639* (2006.01)

(52) U.S. Cl.
CPC ..... *H01R 13/6395* (2013.01); *H01R 13/743* (2013.01)

(58) Field of Classification Search
CPC ..... H01R 13/6395; H01R 13/734; H01R 13/506; H01R 13/4361; H01R 13/74;
(Continued)

(56) References Cited

U.S. PATENT DOCUMENTS 5,263,871 A * 11/1993 Sano ..... H01R 13/62933 439/157
5,775,957 A * 7/1998 Fink ..... H01R 13/4361 439/595
(Continued)

FOREIGN PATENT DOCUMENTS

CN 1658440 A 8/2005
CN 201041894 Y 3/2008
(Continued)

OTHER PUBLICATIONS

Office Action received for Japanese Patent Application No. 2018-551781, dated Dec. 3, 2019, 10 pages. (5 pages of English Translation and 5 pages of Official Copy).

*Primary Examiner* — Vanessa Girardi

(57) ABSTRACT

A panel mount connector includes a housing that mounts to a panel from a terminal side of the panel and a terminal module that is configured to be supported by and inserted in a channel in the housing from a cable side of the panel. A secondary piece can be used to secure the terminal module to the housing and provide sufficient structure robustness while allowing for ease of assembly and disassembly.

3 Claims, 23 Drawing Sheets

(58) Field of Classification Search
CPC .. H01R 13/743; H01R 13/639; H01R 13/518; H01R 13/745; G02B 6/3897; G02B 6/3879
See application file for complete search history.

(56) References Cited

U.S. PATENT DOCUMENTS

| | | | | |
|---|---|---|---|---|
| 5,836,786 | A * | 11/1998 | Pepe | H01R 13/518 439/557 |
| 6,171,146 | B1 * | 1/2001 | Fink | H01R 13/4223 439/595 |
| 6,183,275 | B1 | 2/2001 | Okura et al. | |
| 6,210,217 | B1 * | 4/2001 | Ping | H01R 13/741 439/557 |
| 6,679,726 | B1 | 1/2004 | Tunn et al. | |
| 7,520,764 | B2 * | 4/2009 | Lee | H01R 13/62911 439/153 |
| 7,607,930 | B1 | 10/2009 | Wu | |
| 9,178,306 | B2 | 11/2015 | Shimizu et al. | |
| 2008/0311800 | A1 | 12/2008 | Wu | |
| 2010/0035476 | A1 | 2/2010 | Wu | |
| 2016/0080836 | A1 | 3/2016 | Carreras et al. | |

FOREIGN PATENT DOCUMENTS

| | | | |
|---|---|---|---|
| CN | 101295837 | A | 10/2008 |
| CN | 101529665 | A | 9/2009 |
| CN | 103730770 | A | 4/2014 |
| CN | 204304086 | U | 4/2015 |
| EP | 1855361 | A3 | 9/2008 |
| JP | 2000-315542 | A | 11/2000 |
| JP | 2003-158384 | A | 5/2003 |
| JP | 2005-210777 | A | 8/2005 |
| JP | 2009-043661 | A | 2/2009 |
| WO | 2017/173309 | A1 | 10/2017 |

* cited by examiner

PANEL MOUNT CONNECTOR WITH TERMINAL MODULE SECURED TO CONNECTOR HOUSING

RELATED APPLICATIONS

This application is a national stage of International Application No. PCT/US2017/025441, filed Mar. 31, 2016, which claims priority to U.S. Provisional Application No. 62/316,220, filed Mar. 31, 2016, both of which are incorporated herein by reference in their entirety.

TECHNICAL FIELD

This disclosure relates to the field of connectors, more specifically to connectors suitable for use in panel mount applications that can also support high data rates.

DESCRIPTION OF RELATED ART

Panel mount connectors are known. As can be appreciated from FIGS. 1-4, existing panel mount connectors, such as panel mount connector 10, have several issues if they are being used to support higher data rates. In a typical application, a panel mount connector assembly 10 includes a housing 20 that has a two-piece construction that partially envelops and supports a terminal module 40. The terminal module 40 includes a terminal array 26 that is connected to a plurality of cables 44 and supports the terminal array 26 and the cables 44 in the desired position within the housing 20. Once the panel mount cable connector is assembled it is inserted in a panel aperture 8 in a panel 5. Because the cables 44 are connected to another connector on another end, the panel mount connector 10 is inserted into the panel aperture 8 from a cable side 6 so that the terminal array 26 is presented on a terminal side 7. To aid in mating with a mating connector, an alignment pin 28 can be supported by a pin block 29. The panel mount connector 10 is inserted into panel aperture 8 until a tab 21 and ears 23 are pressed against the panel 5. A fastener 11 then operates to help secure the panel mount connector 10 in position.

A second embodiment of a panel mount connector 10' includes a housing 20' with flex tab 31. The housing 20' supports the alignment pin 28 and provides the terminal array 26 supported by a terminal module 40' on the terminal side 7. The second embodiment includes connector stops 22 that prevent over-insertion of the panel mount connector into the aperture and the flex tab prevents the panel mount connector 10' from being inadvertently removed.

As can be appreciated, these existing designs constrain the cable with the terminal module and do not allow the cable to be removed without removing and disassembling the entire panel mount connector. Due to the cables 44 routing back to another connection, the panel mount connectors also needs to be inserted into the panel aperture 8 from the cable side 7. Routine checks, maintenance or changes become difficult with existing solutions as it can be difficult to access the inside of the panel when the panel mount connector is part of a much larger system where space or access to the cable side 6 of the panel 5 is limited. The existing designs also mean that the latches and/or fasteners used to secure the panel mount connector to the panel must support the blind mate impact forces and mating forces applied from the terminal side 7 of the panel. These forces can potentially overcome simple to use latching systems and any error in assembly can cause the panel mount connector to be pressed out of the panel aperture 8 (or become angled in the aperture 8), thus inhibiting a connection. As a result, certain individuals would appreciate further improvement to a panel mount connector.

SUMMARY

In an embodiment, a panel mount connector includes a housing that is inserted into a panel aperture from a terminal side of a panel and is configured to support a terminal module that is inserted into the housing from a cable side of the panel. The resulting panel mount connector allows for easy maintenance and inspection of the system. The housing includes a lip or other features that reliably and securely limit the housing from being pressed through the panel aperture while the terminal module can be securely attached to the housing via a secondary piece that takes forces exerted on the terminal module and transfers them to the housing. The secondary piece can be locking member that can be snapped on to the housing or it can be a blocking frame that is inserted through a cut-out in the housing. The resultant design is thus suitable for maintenance while provide increased resistance to mating forces and blind mate impact forces.

BRIEF DESCRIPTION OF THE DRAWINGS

The present invention is illustrated by way of example and is not limited in the accompanying figures in which like reference numerals indicate similar elements and in which.

DETAILED DESCRIPTION

Figure 1:
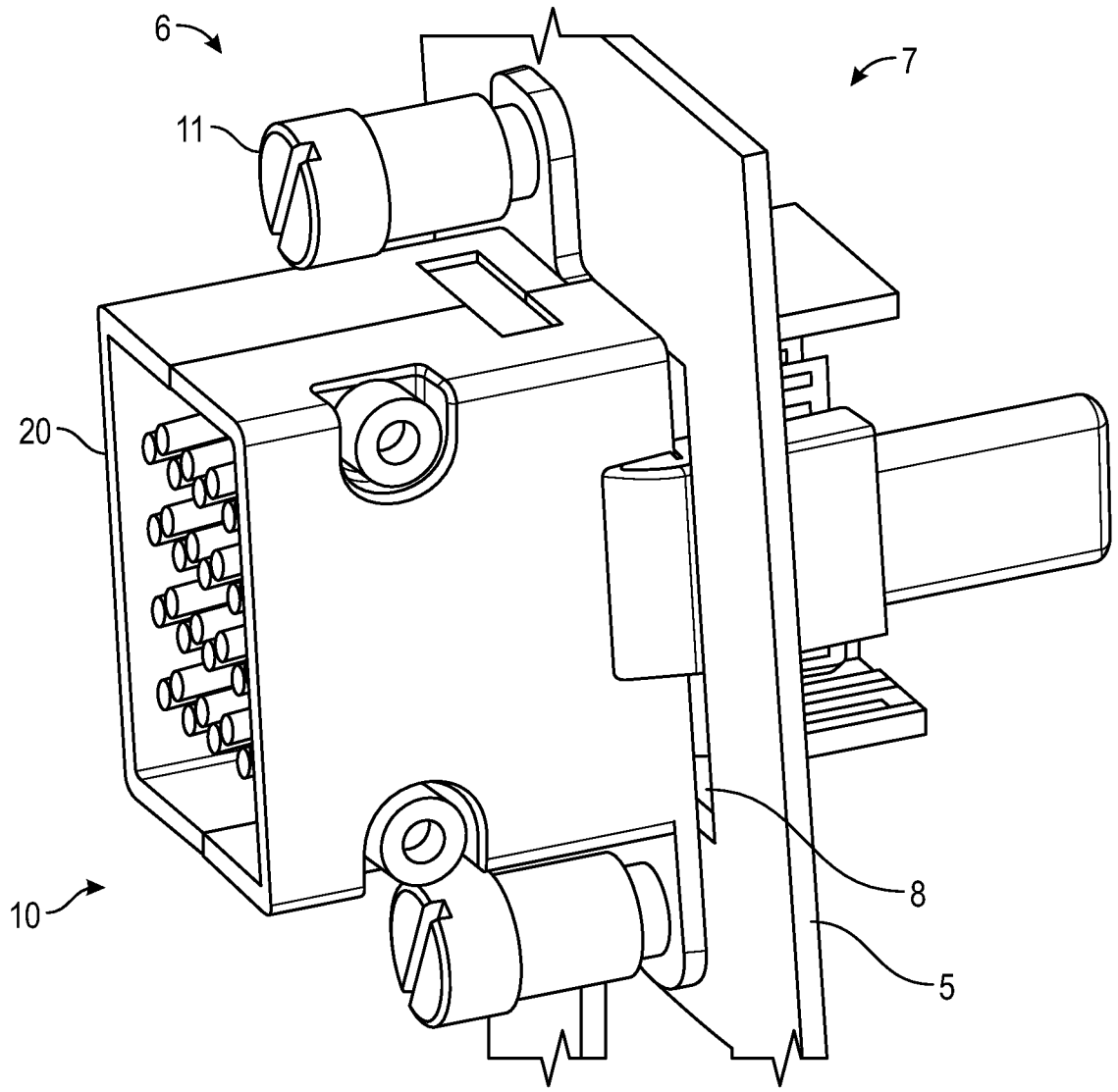
FIG. 1 (Prior Art)
FIG. 1 illustrates a perspective view of a prior art panel mount connector.
Figure 2:
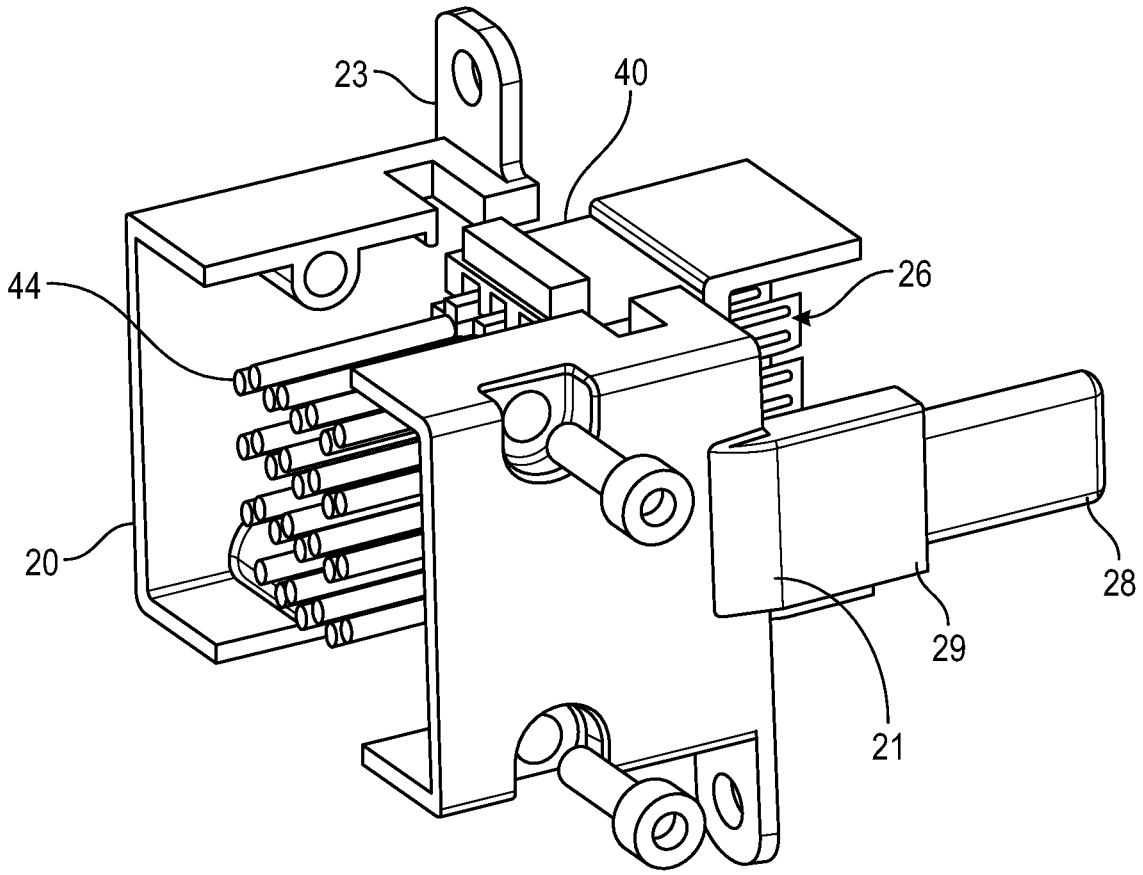
FIG. 2 (Prior Art)
FIG. 2 illustrates a partially exploded perspective view of the embodiment depicted in FIG. 1.
Figure 3:
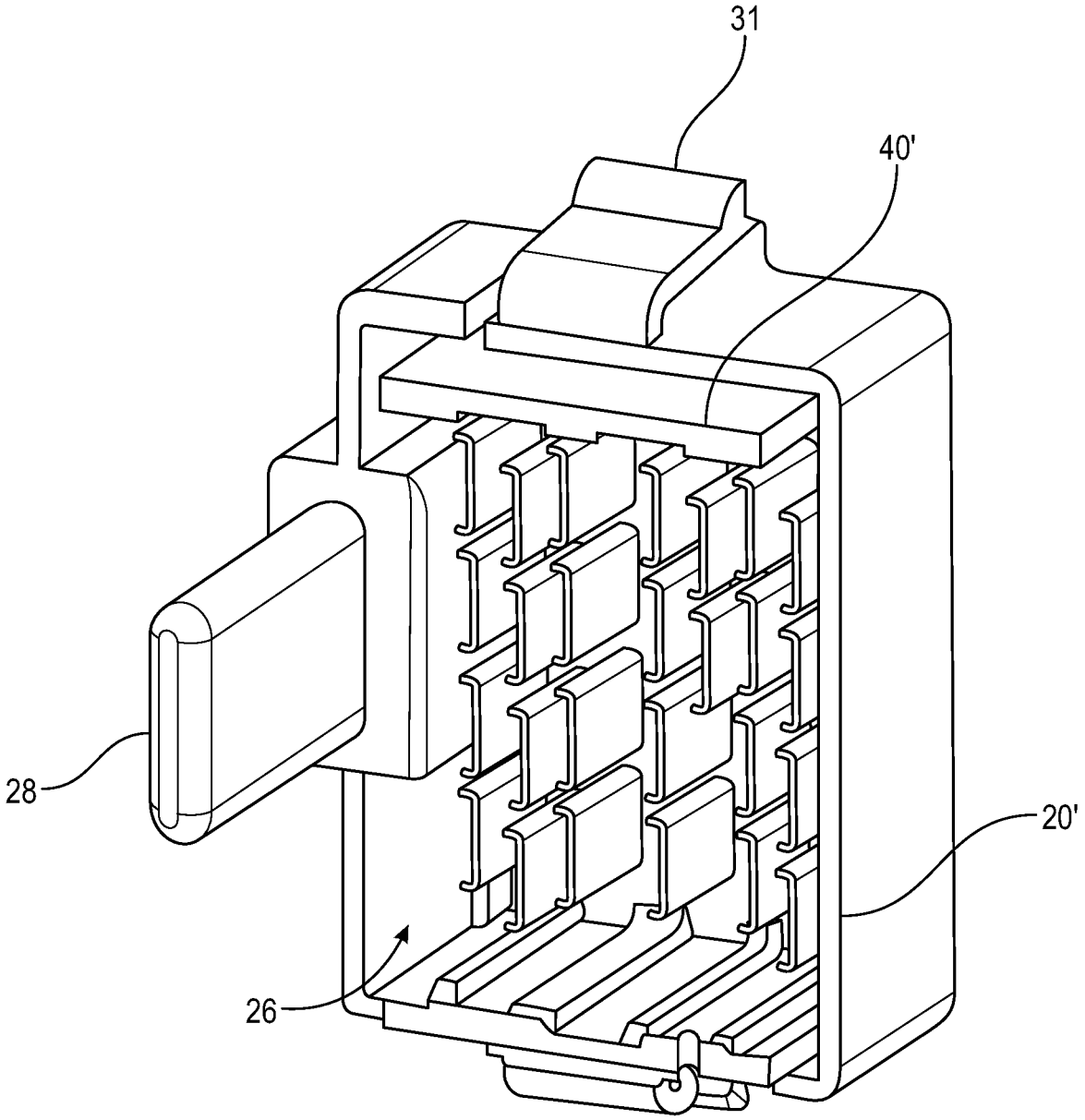
FIG. 3 (Prior Art)
FIG. 3 illustrates a perspective view of another prior art panel mount connector positioned in a panel.
Figure 4:
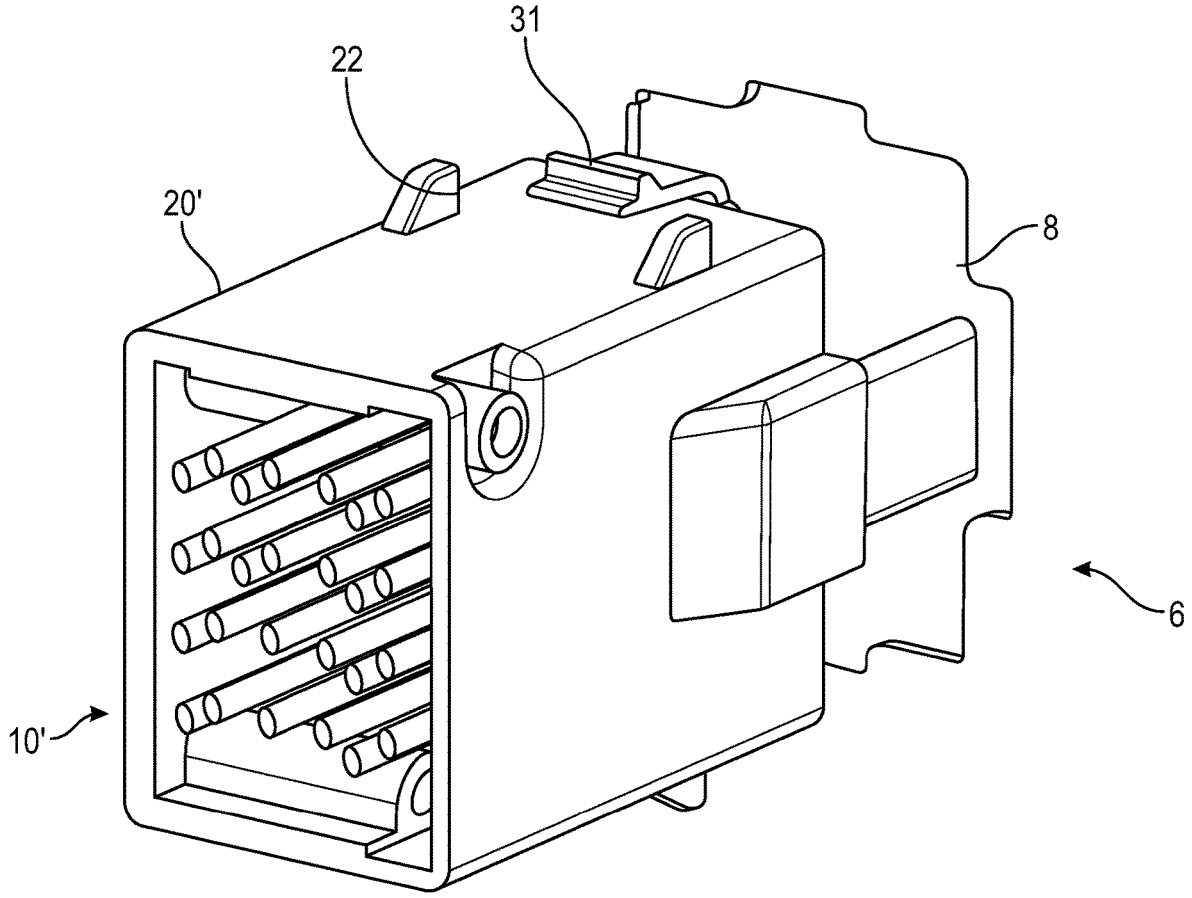
FIG. 4 (Prior Art)
FIG. 4 illustrates another perspective view of the embodiment depicted in FIG. 3 prior to insertion into a panel.
Figure 5:
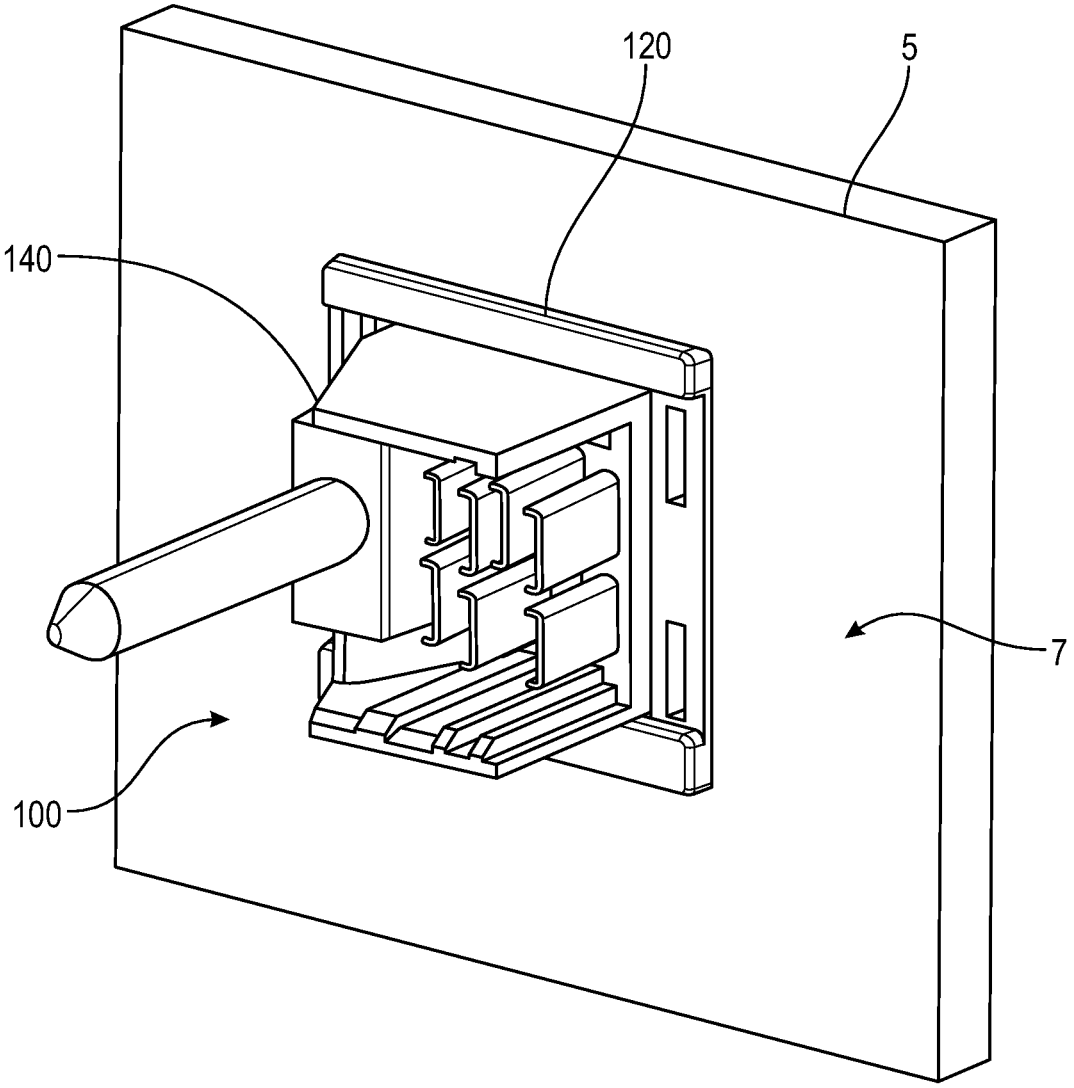
FIG. 5 illustrates a perspective view of an embodiment of a panel mount connector positioned in a panel.
Figure 6:
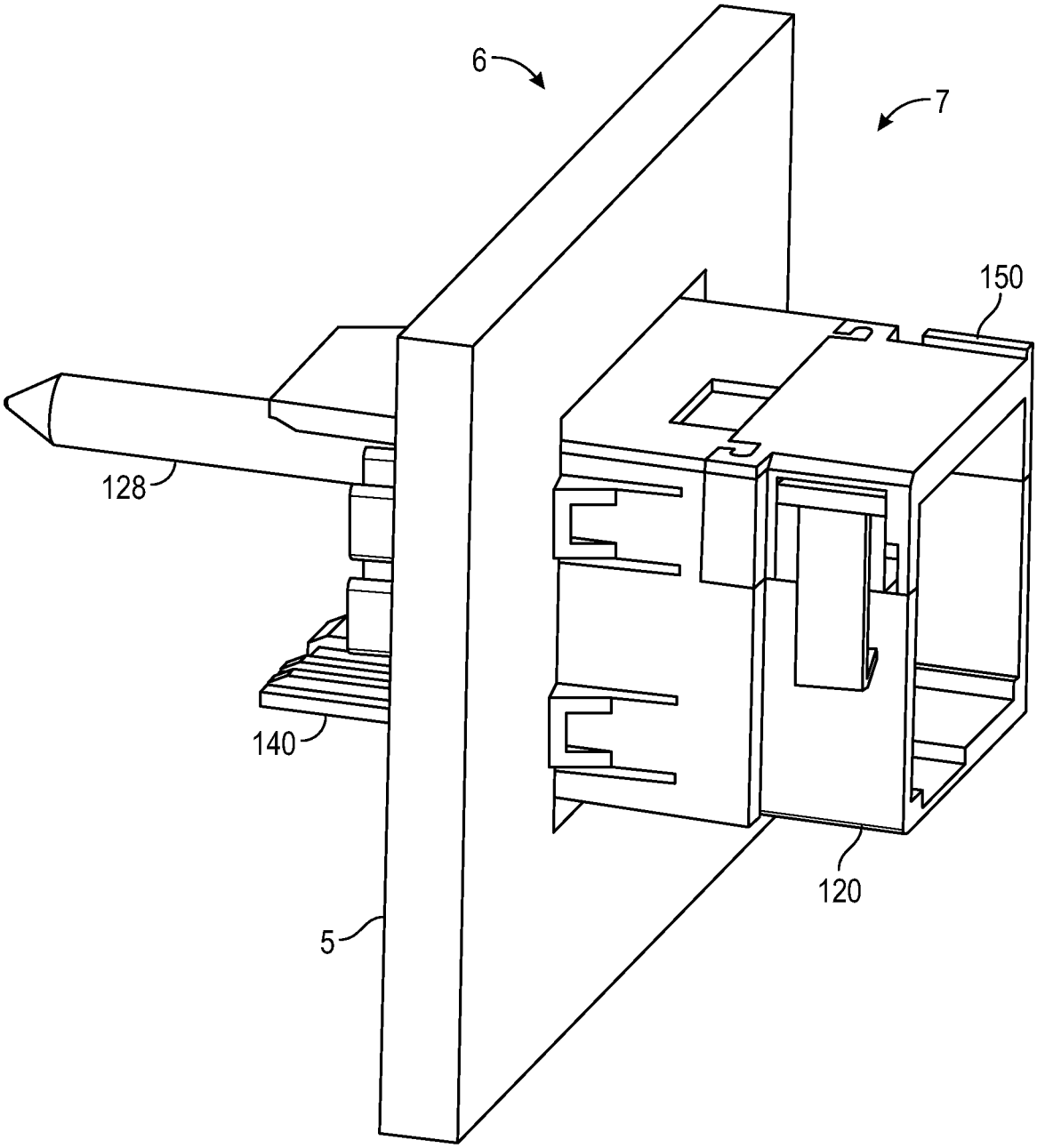
FIG. 6 illustrates another perspective view of the embodiment depicted in FIG. 5.
Figure 7:
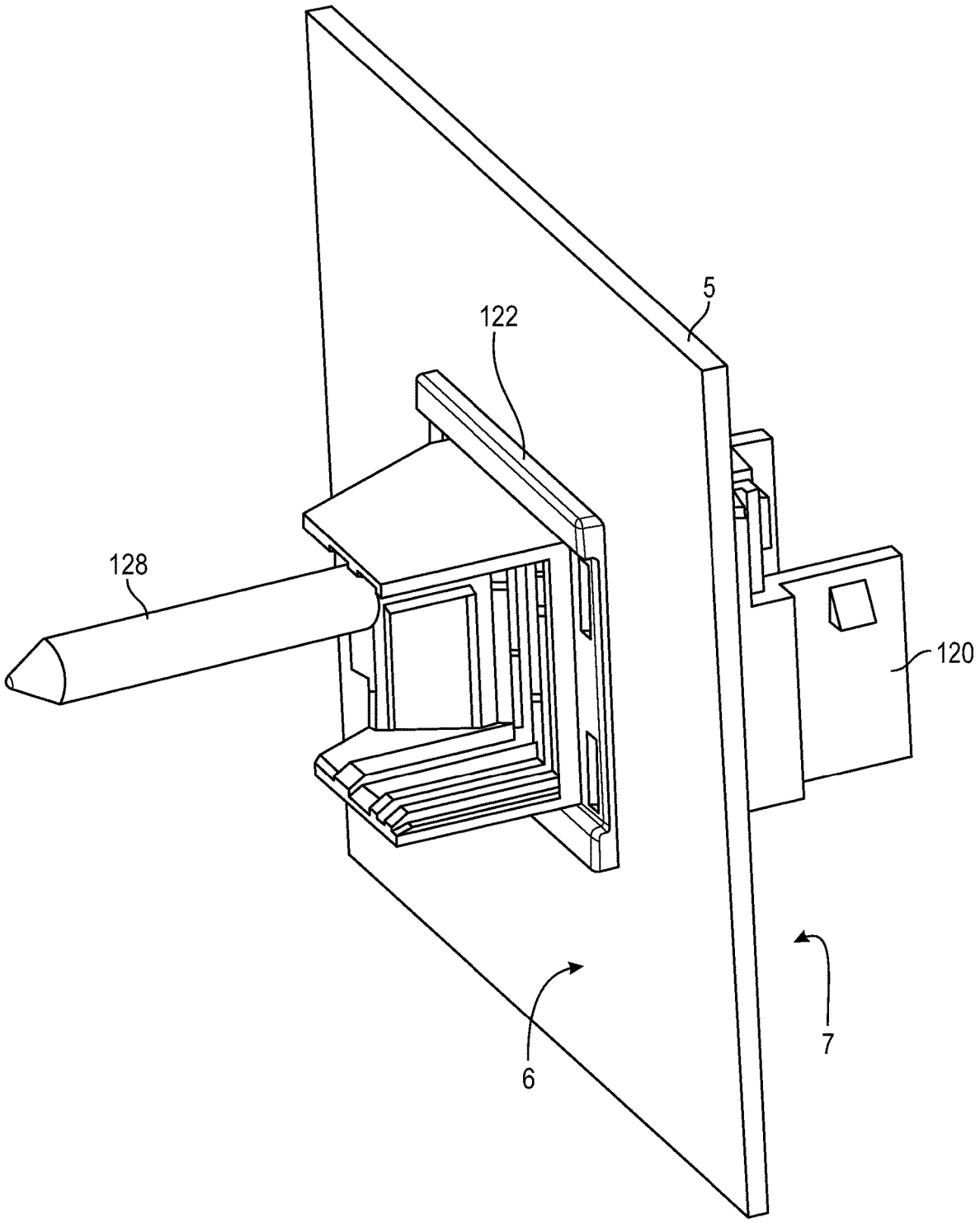
FIG. 7 illustrates a simplified perspective view of the embodiment depicted in FIG. 5.
Figure 8:
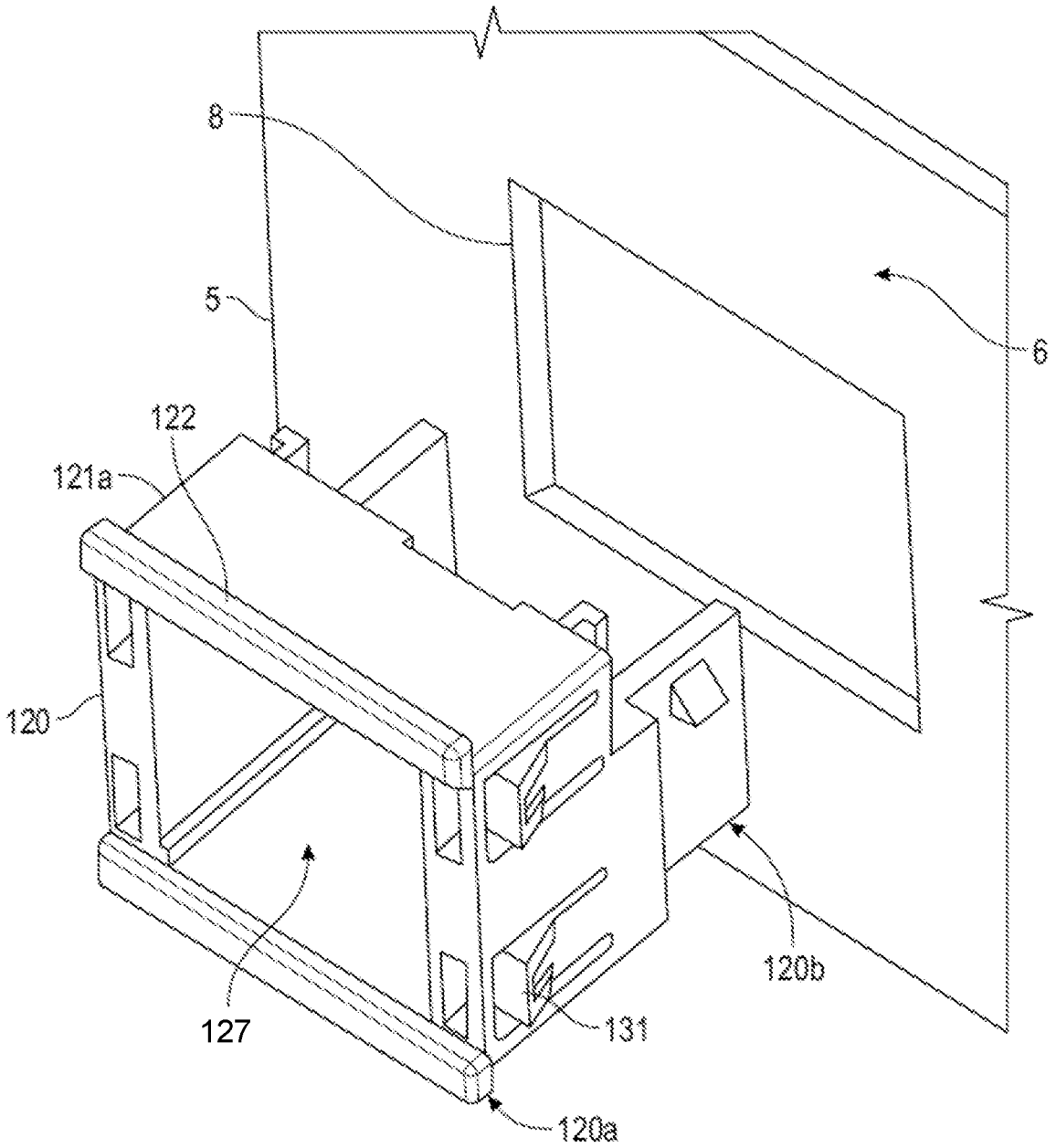
FIG. 8 illustrates a perspective view of a housing suitable for use in a panel mount connector.
Figure 9:
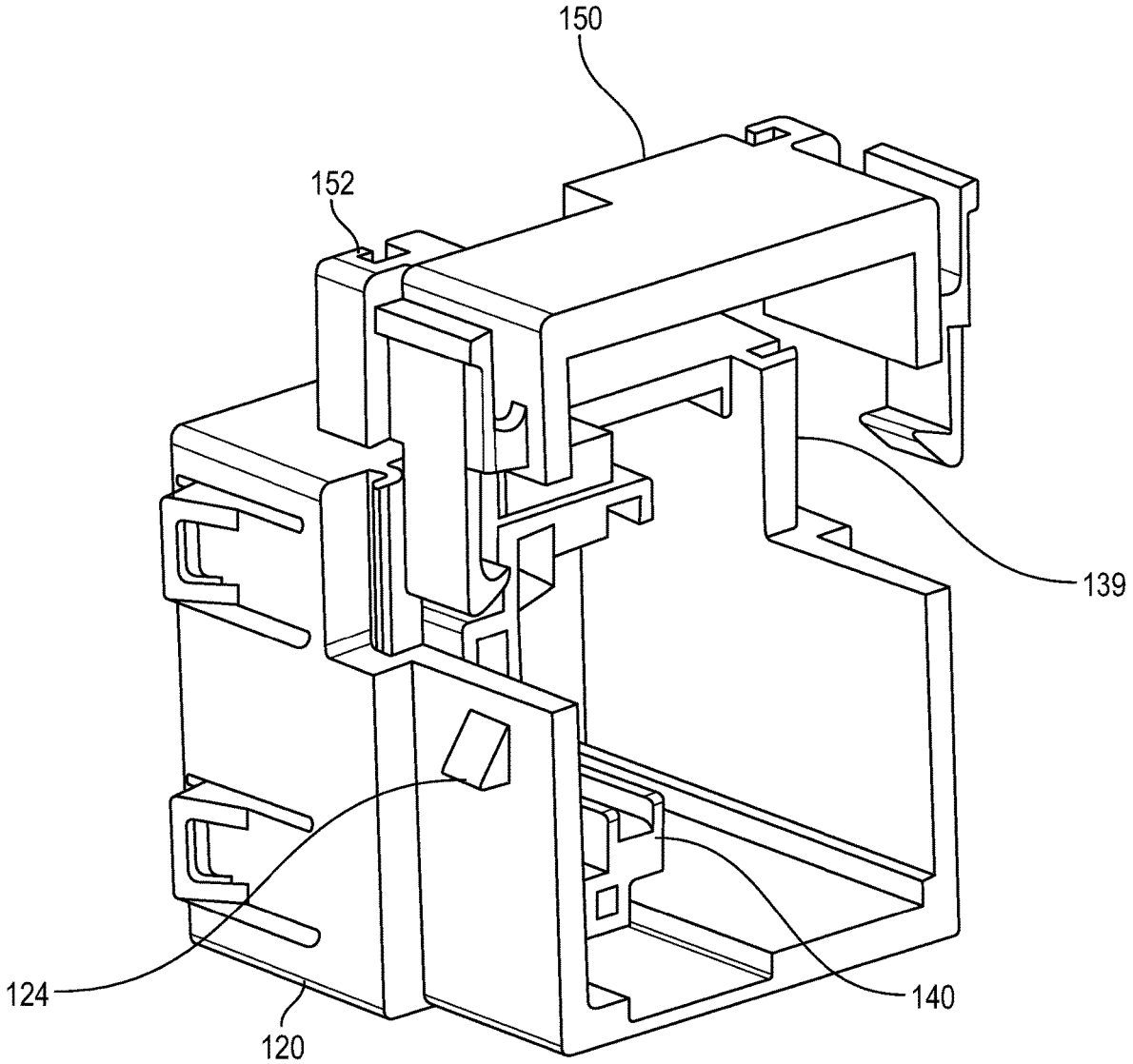
FIG. 9 illustrates a perspective view of an embodiment of a panel mount connector prior to installation of a secondary piece.
Figure 10:
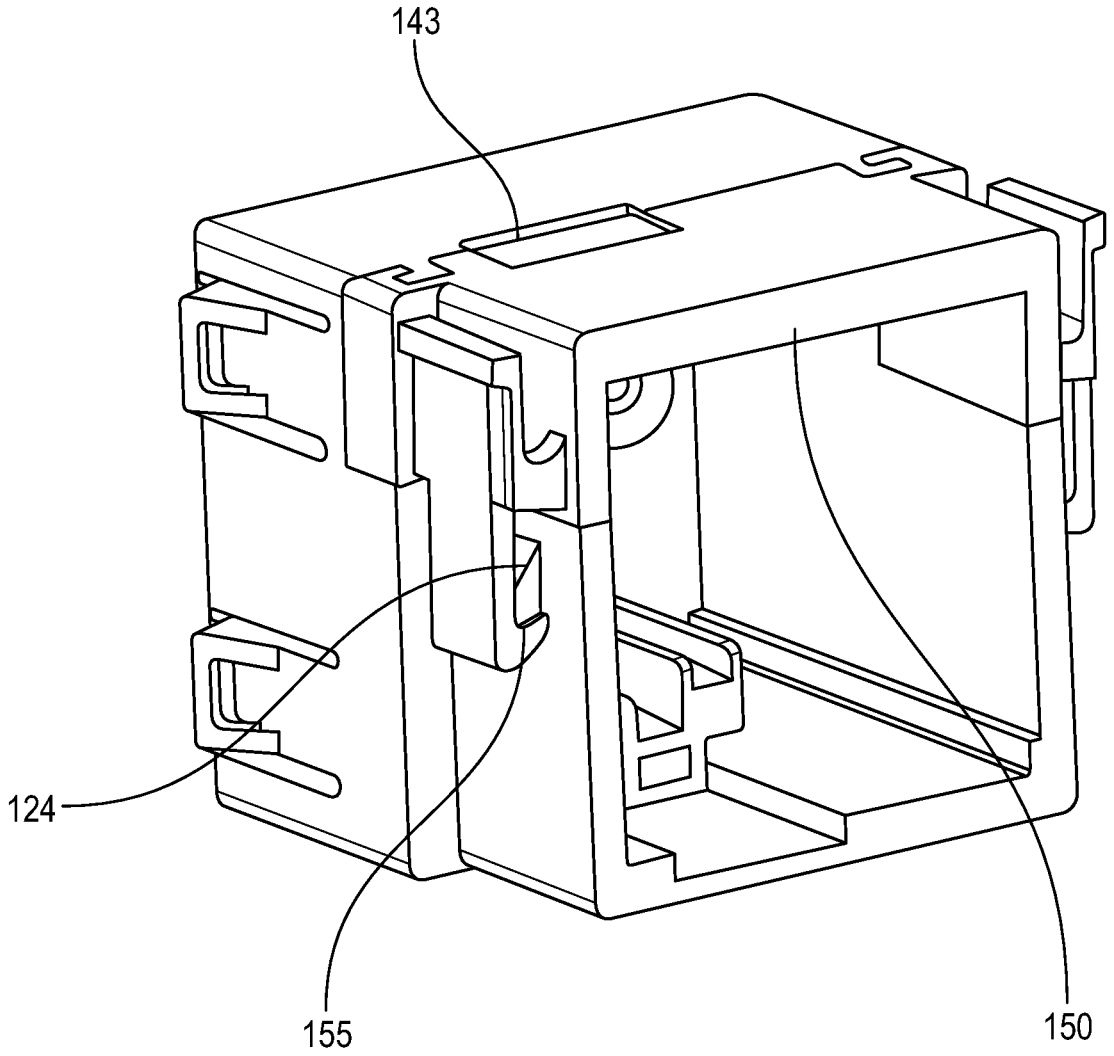
FIG. 10 illustrates a perspective view of the embodiment depicted in FIG. 9 but with the secondary piece installed.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Looking at FIGS. 5-10, features of a first type of embodiment of a panel mount connector are disclosed. A panel mount connector 100 includes housing 120 that defines one or more channels 127 and is configured to mount to the panel 5. Like with some panel mount connectors, the housing 120 includes an outer surface 121*a* that is sized to fit inside a panel aperture 8 with some amount of clearance so that the housing can move somewhat within the panel aperture 8. The channel 127 is configured to receive a terminal module 140 therein and will be sized appropriately. In operation, the housing 120 is inserted into the panel aperture 8 in the panel 5 from a terminal side 6 and is retained by tabs 131 that are designed to deflect during insertion. A lip 122 on provided a front side 120*a* of the housing 120 and extends beyond the outer surface 121*a*. The lip 122 is configured to press up against the panel 5 and prevent the housing 120 from being further inserted into the panel 5. The lip 122 can be sized and formed to provide structure support for the desired forces that are expected to be exerted on the panel mount connector 100. It should be noted that the depicted housing design is rectangular in shape but other shapes could also be provided.

A terminal module 140 is configured to be inserted into the channel 127 on a rear side 120*b* of the housing 120 and is retained by one or more secondary pieces, such as locking member 150, that securely engages the housing 120 and prevents the terminal module 140 from being pushed out of the housing 120. In operation, the secondary piece transfers forces exerted on the terminal module 140 to the housing 120 and the lip 122 transfers those forces to the panel, thus providing a robust configuration. Naturally, multiple secondary pieces can be used if desired.

The terminal module 140 or the housing 120 can also support an alignment pin 128 to aid in mating with an opposing connector. It should be noted that the alignment pin 128 has a cylindrical shape but the shape of the alignment pin 128 can vary based on the mating connector and the type of tolerance desired to be taken up.

As noted above, the locking member 150 is configured to transfer forces exerted on the terminal module 140 to the housing 120. To provide this functionality, as can be appreciated from FIGS. 9-10, in one embodiment the locking member 150 can include a groove 152 that engages a rail 139 in an interlocking manner. Once the locking member 150 is slid down into position, the groove 152 and rail 139 effectively transfer forces from the terminal module 140 to the housing 120. To provide additional security, a retaining arm 155 engages a retaining tab 124 and thus prevents the locking member 150 from being inadvertently removed from the housing 120. The depicted terminal module 140 includes a shoulder 143 that extends at least partially through the housing toward the outer surface 121*a* and further engages the locking member 150 but such a configuration is not required and instead the locking member 150 can be designed to fit into the opening 120*a*.

Figure 11:
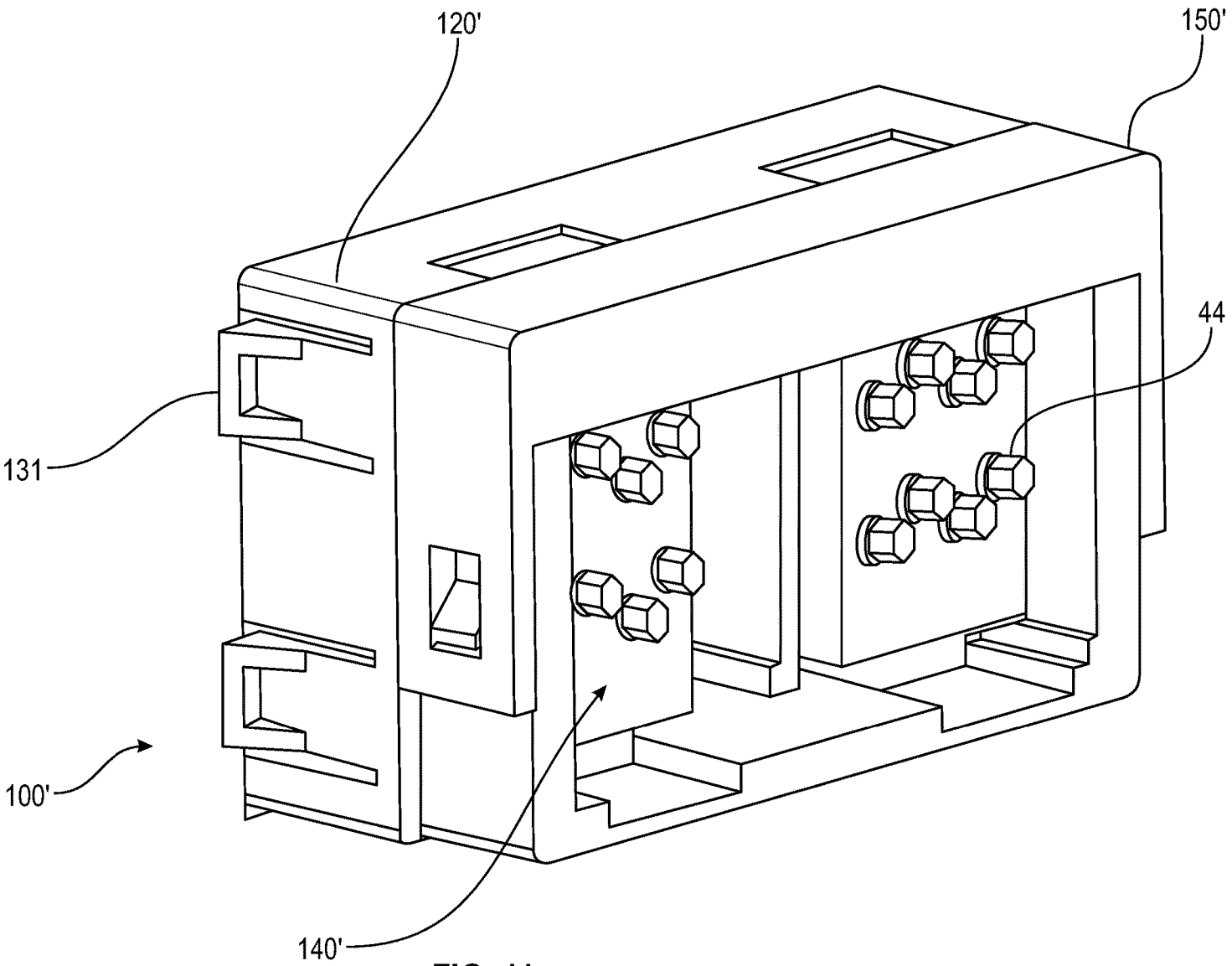
FIG. 11 illustrates a perspective view of another embodiment of a panel mount connector.

As can be appreciated from FIG. 11, which depicts a modified embodiment of a panel mount connector, a housing 120' can be configured to support multiple terminal modules 140' and can include a single locking member 150' that secures each of the terminal modules 140'. As in the above embodiments the terminal modules 140' can have cables 44 extending therefrom.

Figure 12:
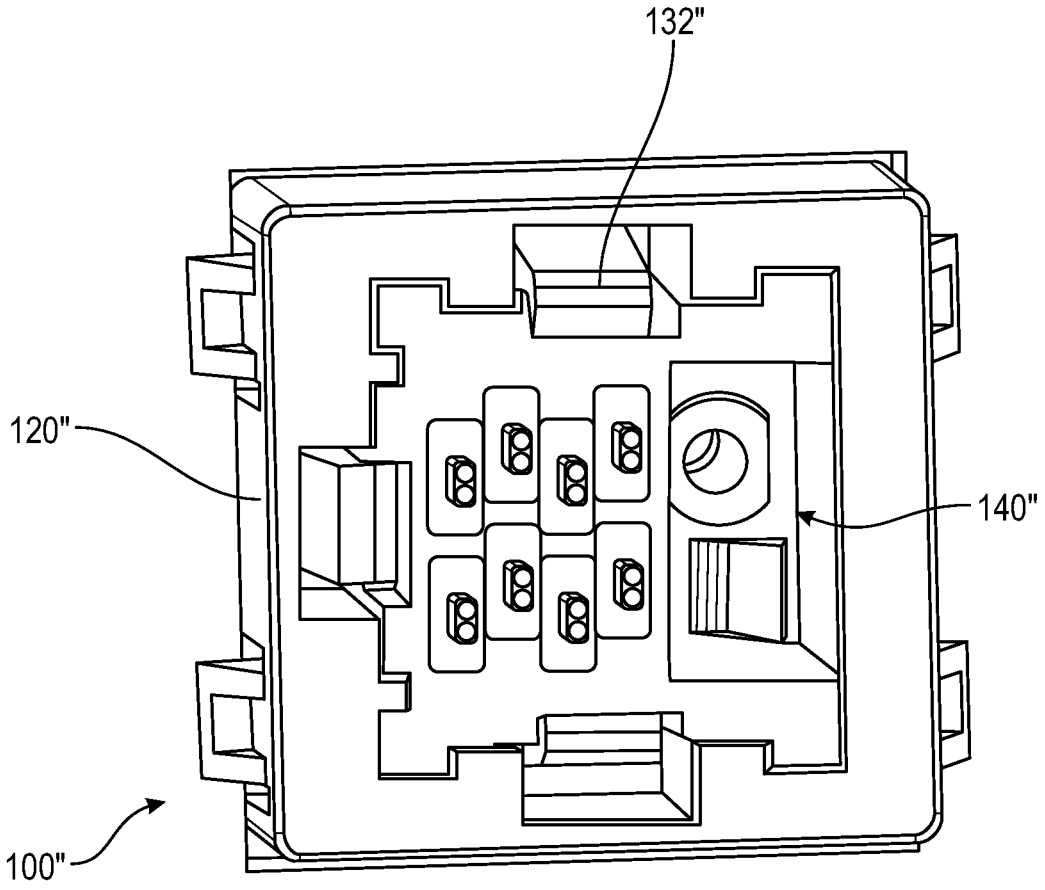
FIG. 12 illustrates a perspective view of another embodiment of a panel mount connector.
Figure 13:
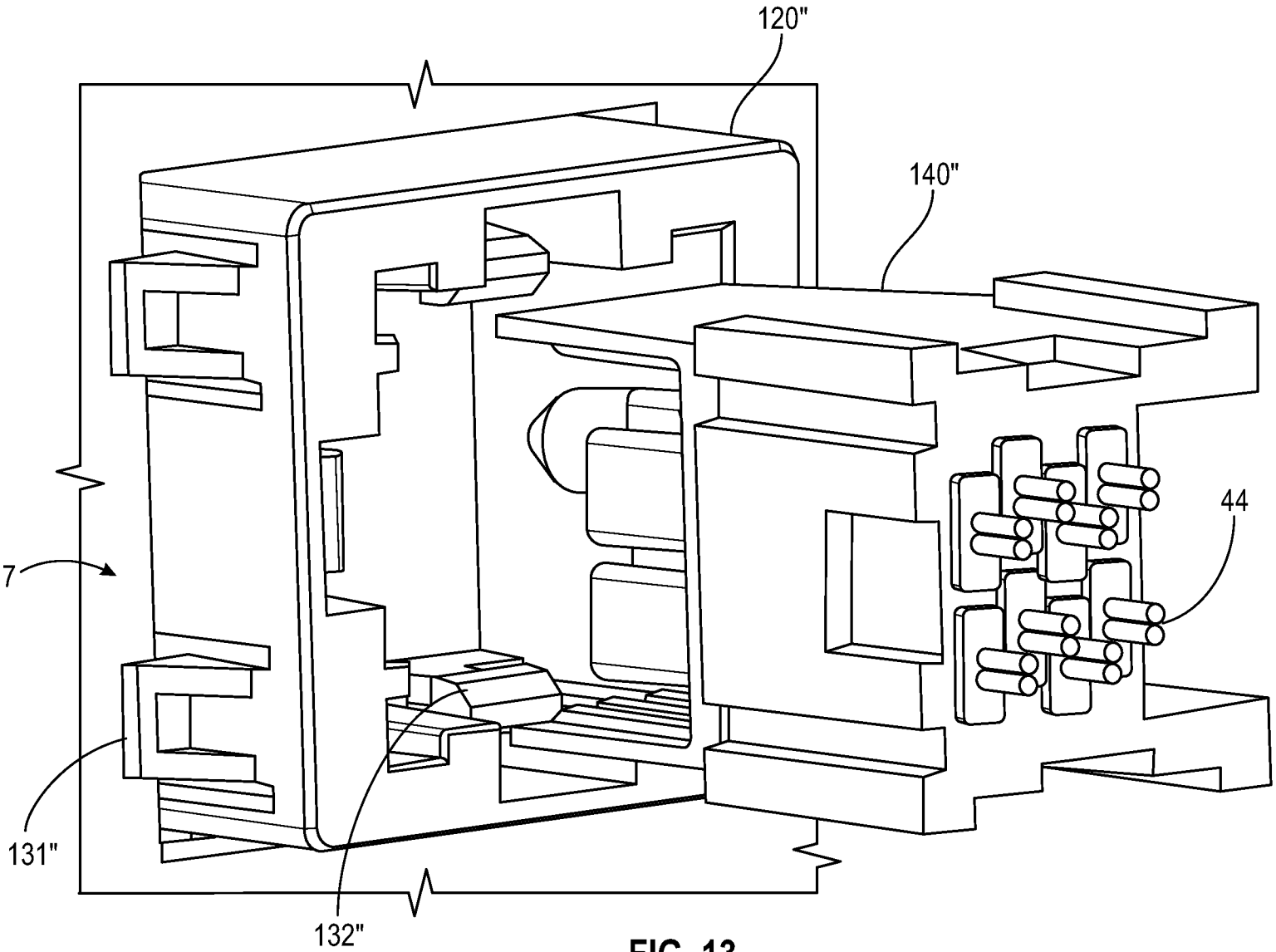
FIG. 13 illustrates a partially exploded perspective view of the panel mount connector depicted in FIG. 12.

An alternative embodiment of a panel mount connector 110" is depicted in FIGS. 12 and 13. A housing 120", which includes a design similar to housing 120 and thus uses tabs 131" to help retain the housing 120" in the panel aperture 5, supports the terminal module 140" but uses retaining legs 132" instead of a secondary piece to retain the terminal module 140" in the housing 120". To provide sufficient structural support, three legs 132" are used. Such a design makes it simple to insert the terminal module 140" in position in the housing 120" but potentially makes disassembly more difficult.

Figure 14:
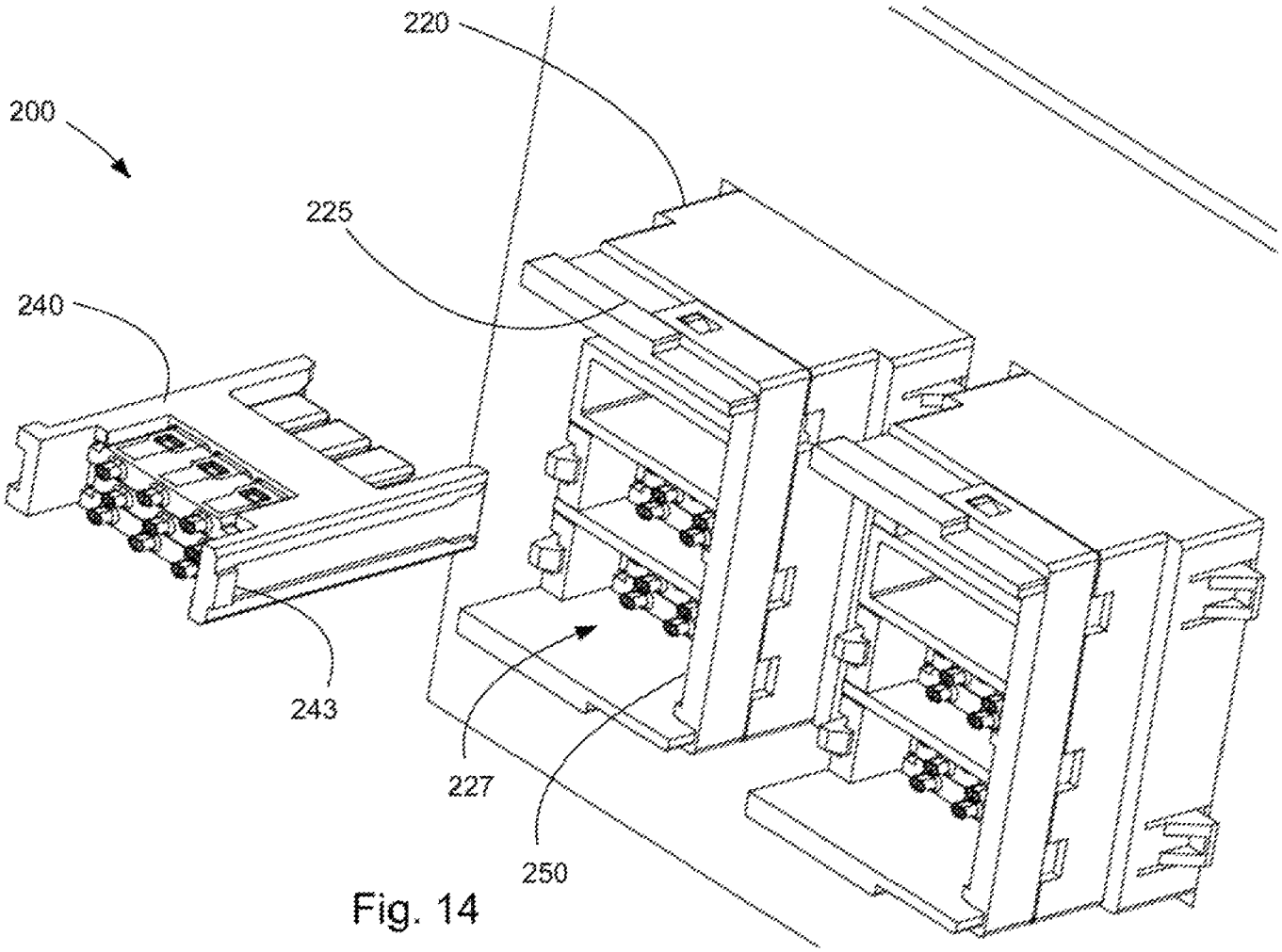
FIG. 14 illustrates a perspective view of another embodiment of a panel mount connector.
Figure 15:
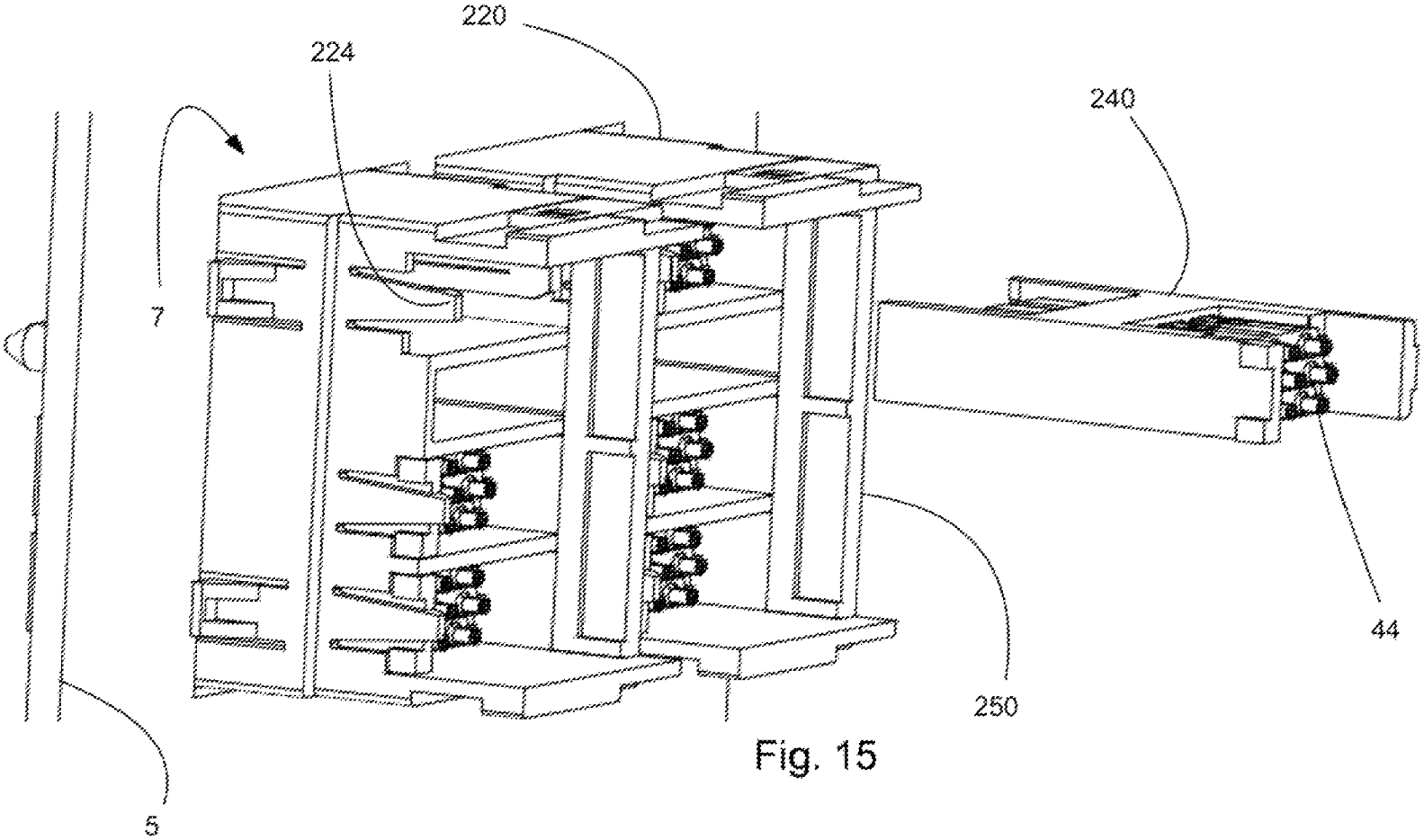
FIG. 15 illustrates another perspective view of the embodiment depicted in FIG. 14.
Figure 16:
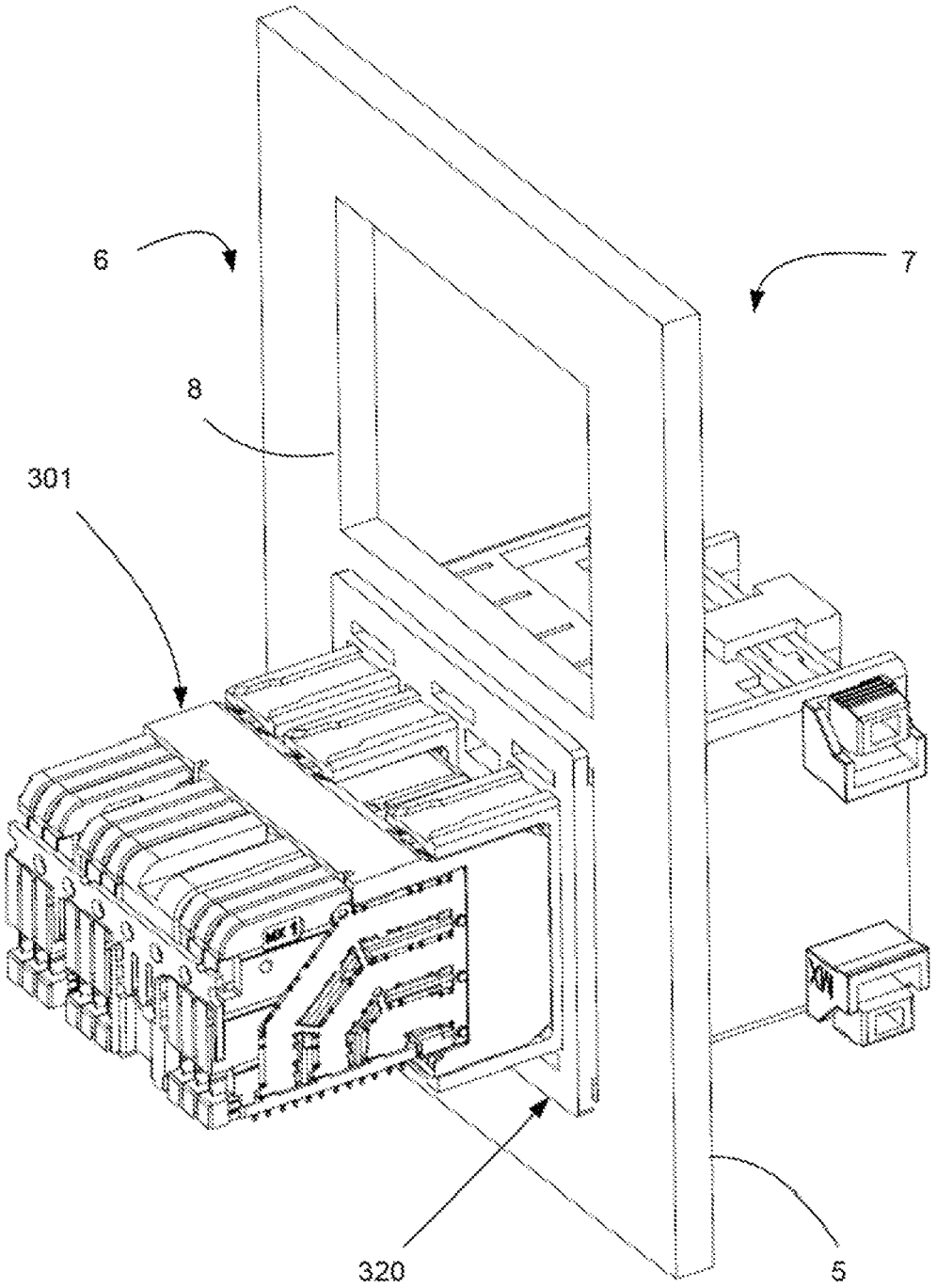
FIG. 16 illustrates a perspective view of another embodiment of a panel mount connector positioned in a panel and mated to a mating connector.
Figure 17:
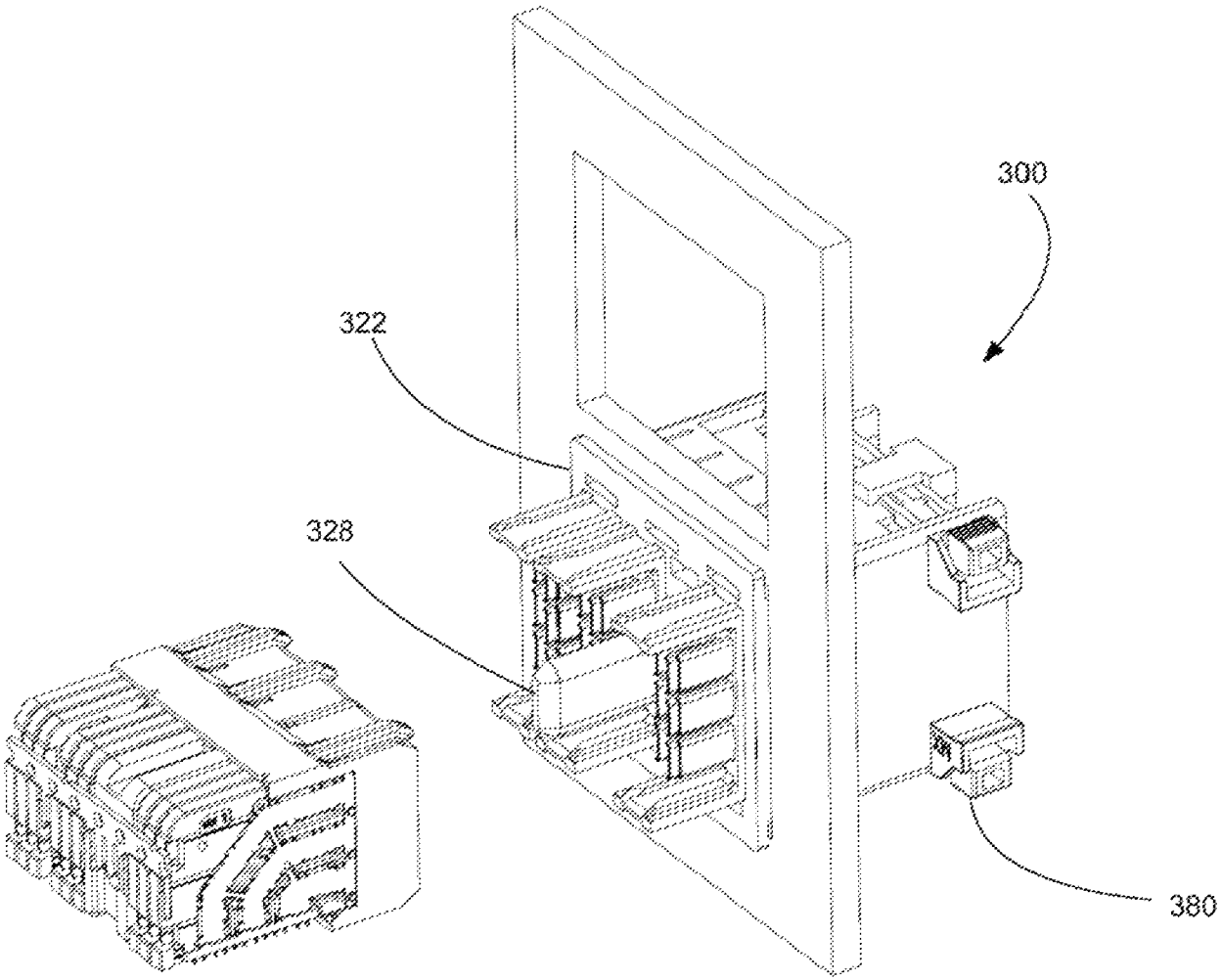
FIG. 17 illustrates a perspective view of the embodiment depicted in FIG. 16 with the mating connector in an unmated condition.
Figure 18:
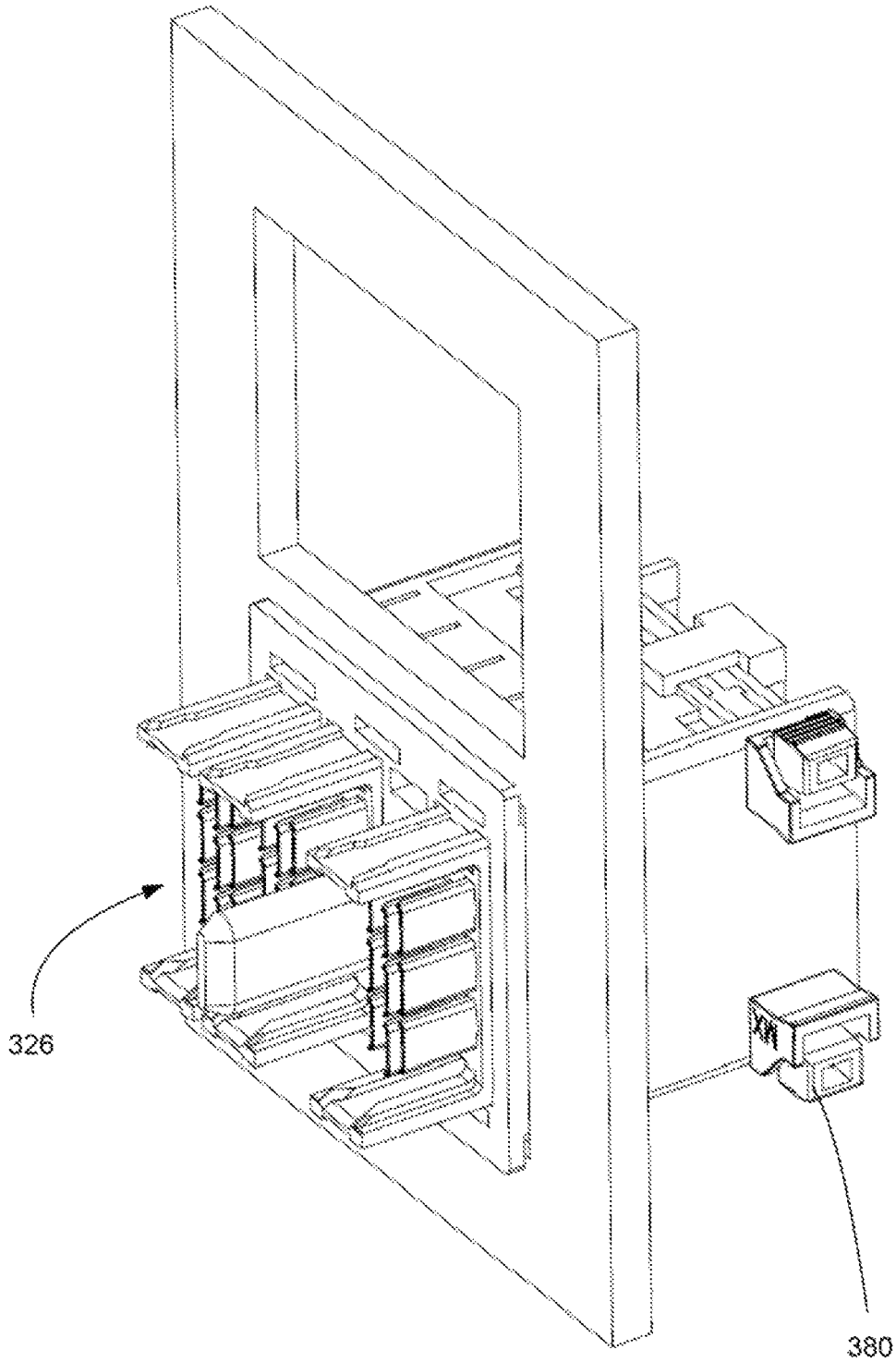
FIG. 18 illustrates a perspective view of the panel mount connector depicted in FIG. 17.
Figure 19:
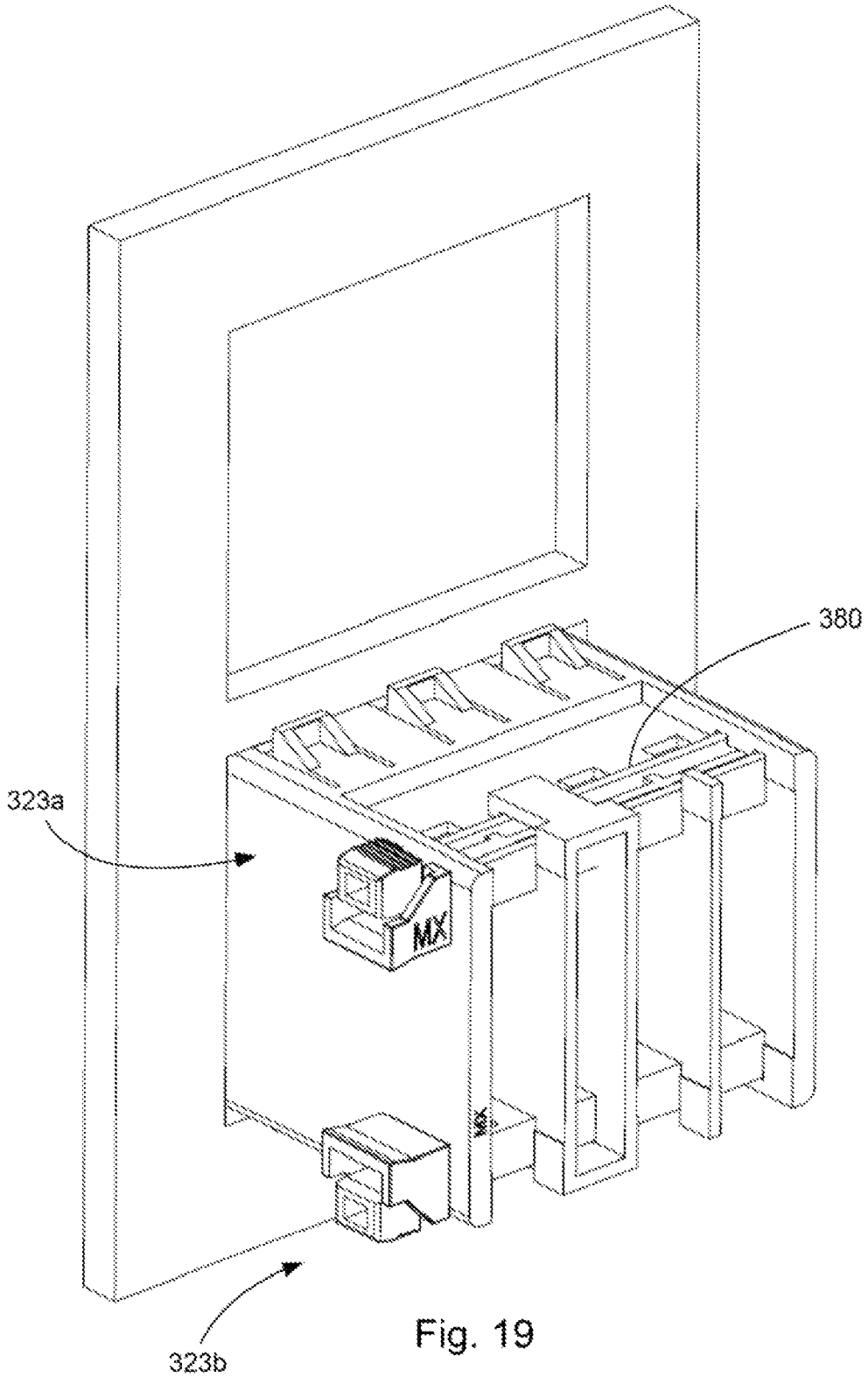
FIG. 19 illustrates another perspective view of the embodiment depicted in FIG. 18.
Figure 20:
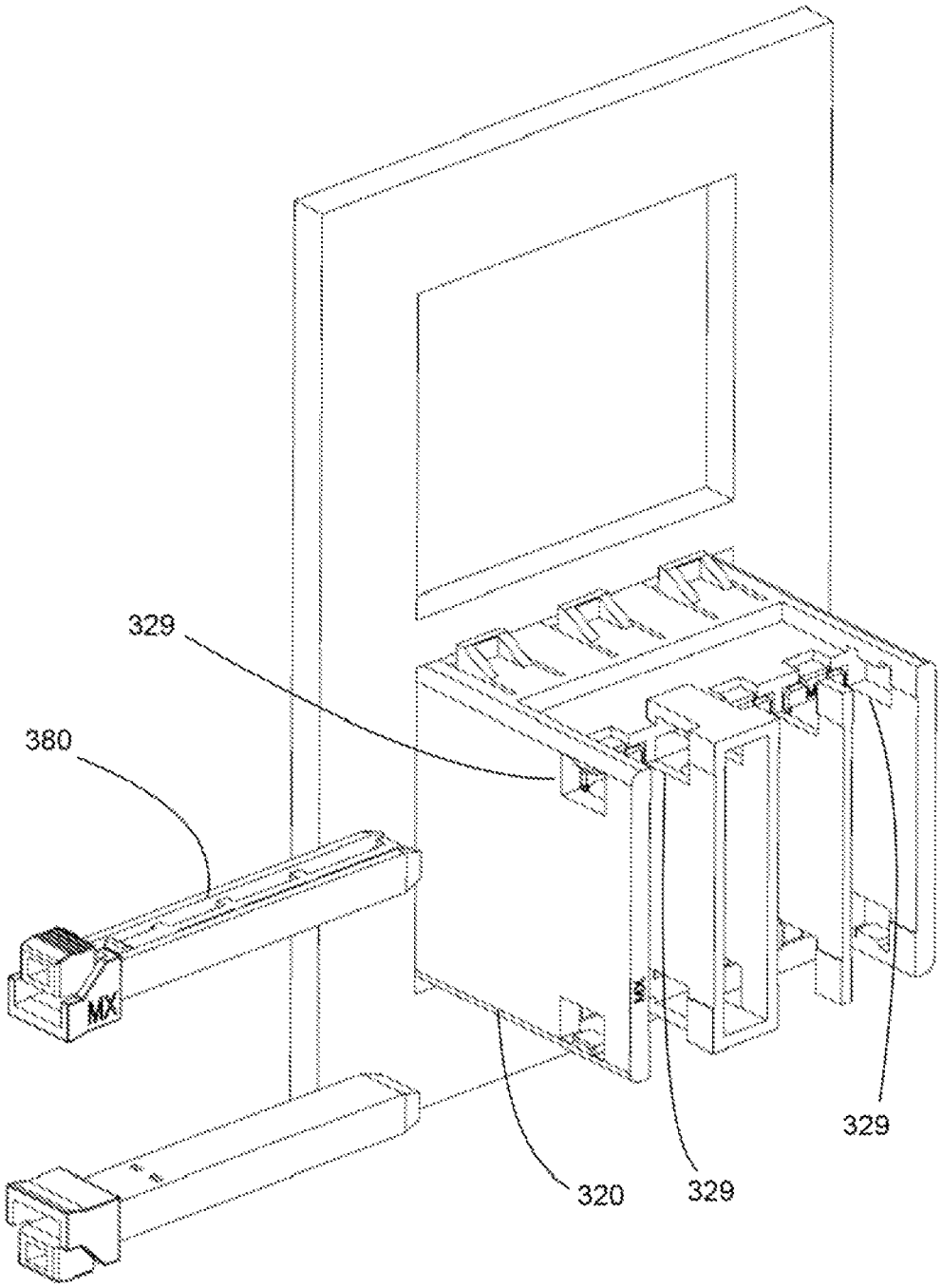
FIG. 20 illustrates a partially exploded perspective view of the embodiment depicted in FIG. 19.
Figure 21:
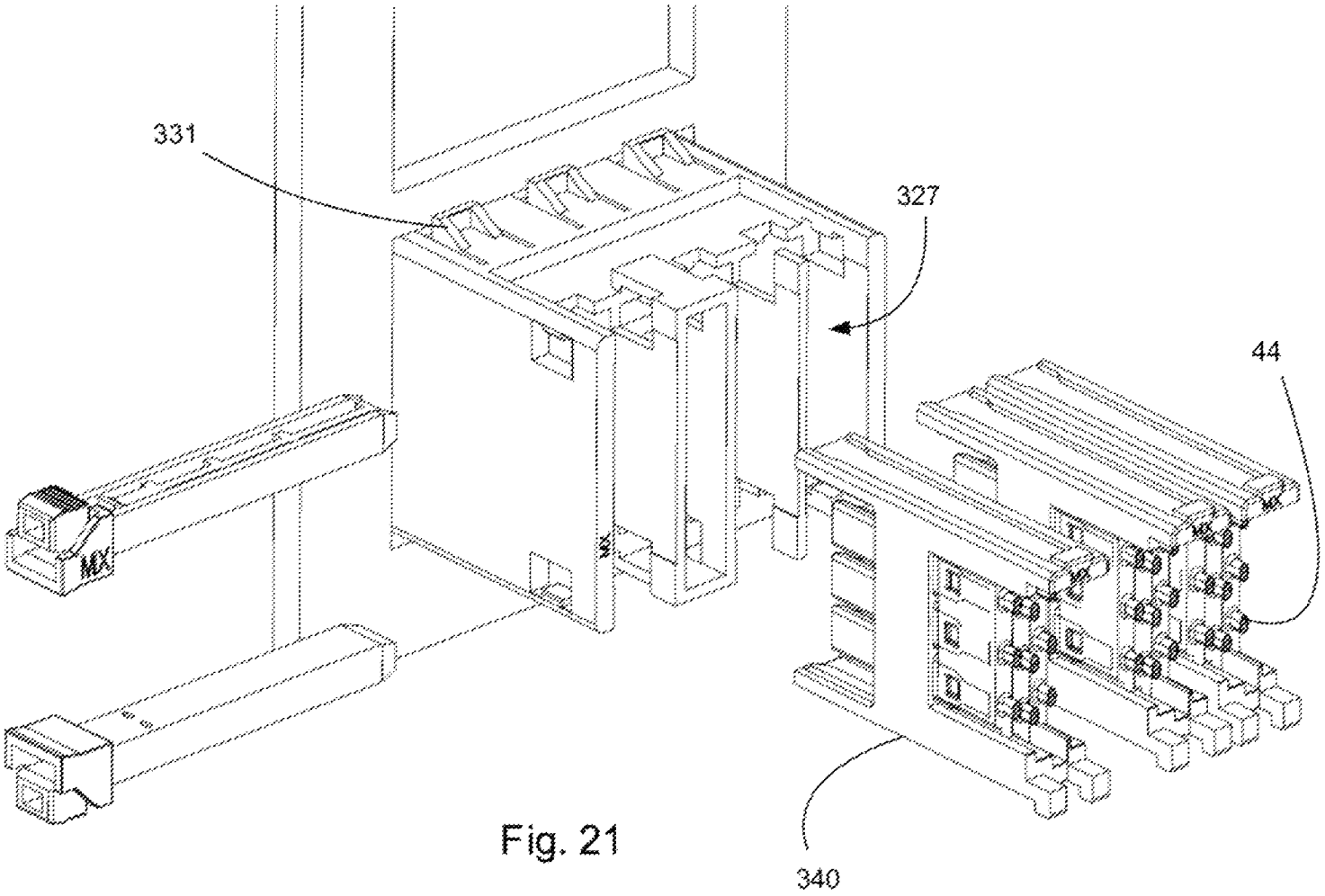
FIG. 21 illustrates a further exploded perspective view of the embodiment depicted in FIG. 20.
Figure 22:
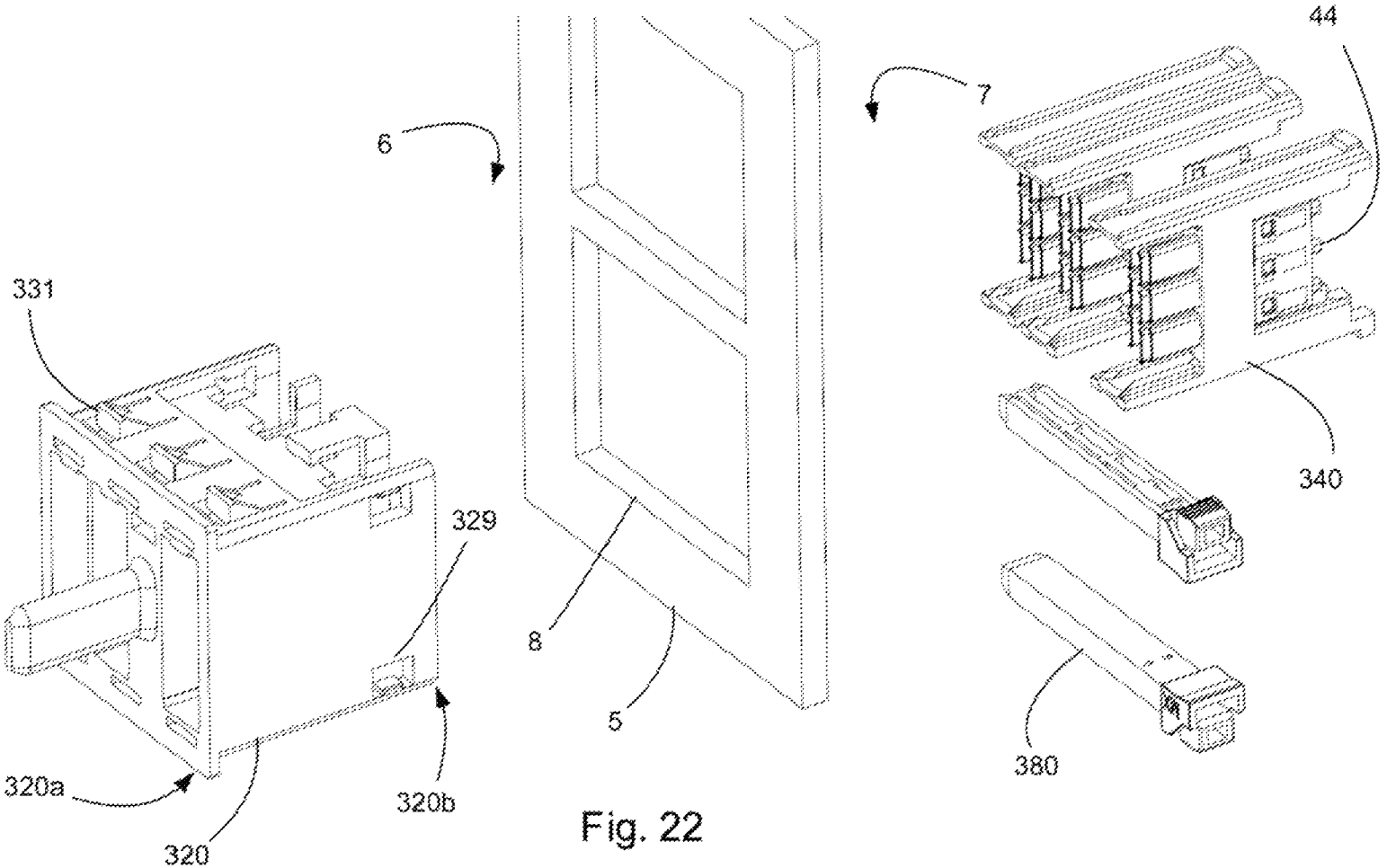
FIG. 22 illustrates another perspective and further exploded view of the embodiment depicted in FIG. 21.
Figure 23:
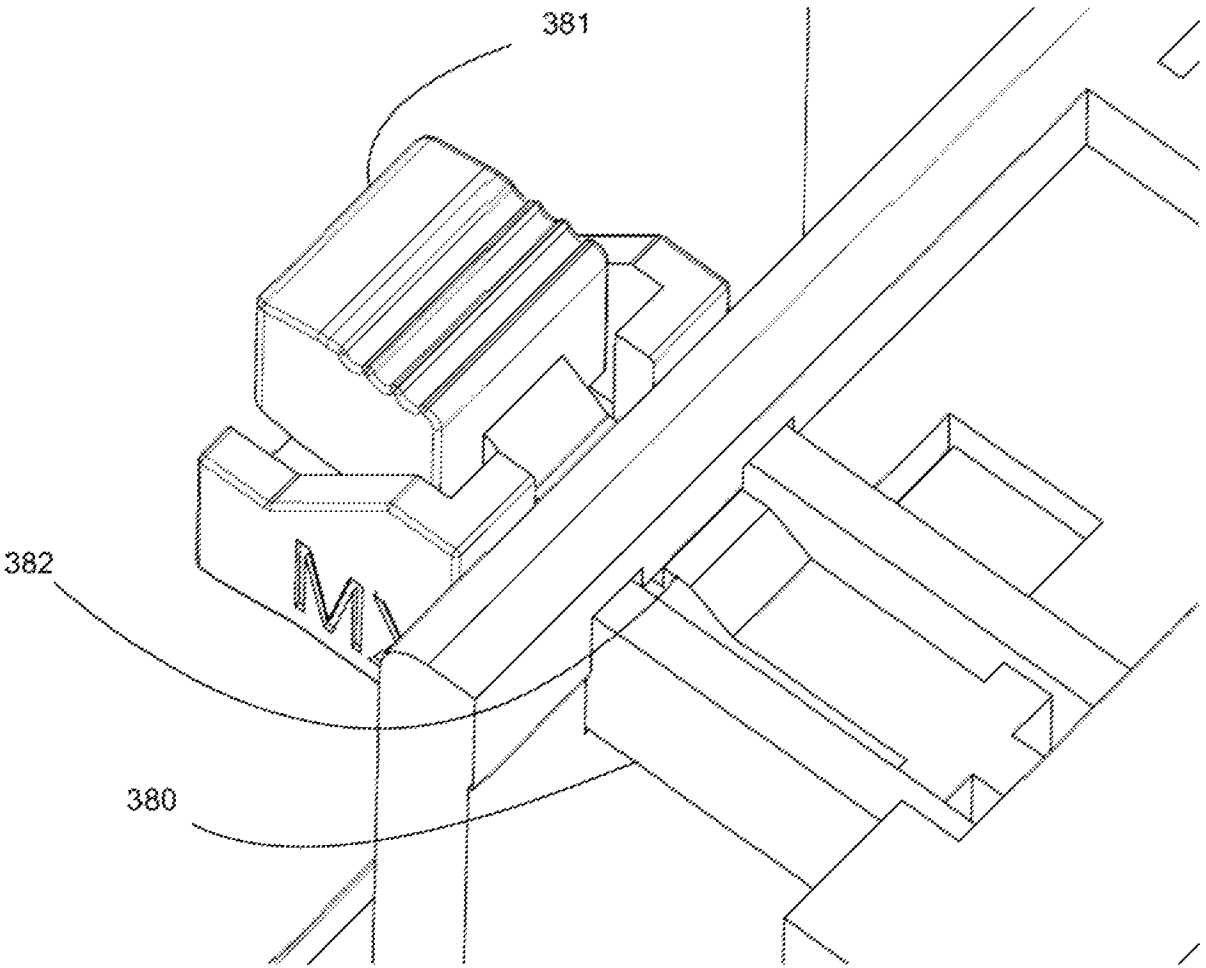
FIG. 23 illustrates a enlarged perspective view of features of an embodiment of a secondary piece.

In another embodiment of a panel mount connector 200, which is depicted in FIGS. 14-15, a housing 220 provides channels 227 that accept one or more terminal modules 240 and the terminal modules 240 are inserted into a housing 220 from the cable side while the housing is mounted on the panel from the terminal side. The terminal module 240 includes a shoulder 243 that is engaged by a locking member 250. The locking member 250 can be configured to engage the housing 220 in an interlocking manner, such as be being positioned in a channel 225, to effectively transfer force from the terminal module 240 to the housing 220. To help retain the terminal modules 240 in the housing prior to mounting the locking member 250 on the housing 220, fingers 224 can be provided to engage the terminal module 240.

FIGS. 16-23 illustrate another embodiment of a panel mount connector 300 that is configured to be positioned in the panel aperture 8 of panel 5 and is configured to mate with a mating connector 301. The panel mount connector 300 is similar in construction to the panel mount connectors discussed above and thus most of the similar features will not be discussed again for purposes of brevity as a person of skill in the art would appreciate that the same type of feature can provide the same type of benefits. As can be appreciated, the panel mount connector 300 includes a housing 320 with a lip 322 on a front side 320*a* that mounts to the panel 5 from the terminal side 6, as discussed above, and the lip 322 is configured to provide structural support to resist mating forces. Tabs 331 help secure the housing 220 to the panel 5 in a manner similar to the previously discussed embodiments. A plurality of terminal modules 340 are inserted into a plurality of channels 327 on a rear side 320*b* of the housing 320 from the cable side 7 of the panel 5 and are connected to cables 44 and as discussed above, the terminal modules provide a terminal array 326 on the terminal side 6.

One difference with this embodiment is that the secondary piece used to secure the terminal modules 340 into position is a locking post 380. The locking post 380 is inserted into two or more housing apertures 329 and is positioned behind the terminal modules 340. Such a construction has been found to securely retain the terminal modules 340 into position and is also effective at transferring force from the terminal modules 340 to the housing 320. In the depicted embodiment two locking posts are provided on two sides 323*a*, 323*b* of the housing 320 to distribute force more evenly and to increase the robustness of the design but a single locking post 380 may be sufficient for many applications.

The locking post 380 can include a latch 382 that secures the locking post 380 in position in the housing 320. In an embodiment the locking post can include a release tab 381 to allow for deflection of the latch and corresponding easy removal of the locking post 380 from the housing 320.

As can be appreciated from the above designs, therefore, while the housing of the panel mount connector can be mounted from the terminal side of the panel, the terminal module are inserted into the housing from the cable side of the panel so as to allow for easy assembly of the panel mount connector to the panel. A secondary piece acts to transfer force exerted on the terminal modules to the housing and thus ensures a robust design. In addition to improving the robustness of the design, such a configuration has an additional benefit of providing for easy removal of the terminal modules for routine maintenance or inspection of the system without having to remove/disassemble the housing from the panel.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A panel mount connector for mounting in an aperture of a panel, comprising:

a housing with an outer surface and a lip on a front side of the housing, the lip extending beyond the outer surface, the housing having a rear side opposite the front side and defining a channel that extends from the front side to the rear side;

a terminal module that is inserted into the channel from the rear side, the terminal module supporting a plurality of terminals; and a secondary piece that secures the terminal module to the housing, wherein the secondary piece is a locking post that is inserted into a plurality of housing apertures that are positioned near the rear side, the plurality of housing apertures being aligned in a side-to-side direction that is transverse to the channel which extends front side to rear side, the locking post being inserted into the plurality of housing apertures in the side-to-side direction, the locking post, when inserted, having a blocking portion that blocks removal of the terminal module from the channel, wherein the blocking portion of the locking post is positioned transverse to the channel and wherein the locking post includes a release tab that is configured to be deflected by a user in operation and the release tab secures the locking post in the housing.

2. The panel mount connector of claim 1, wherein the terminal module has a shoulder that extends partially through the housing toward the outer surface.

3. The panel mount connector of claim 1, wherein the locking post includes a latch that secures the locking post in the housing.

* * * * *